US008027595B2

(12) United States Patent
Lee et al.

(10) Patent No.: US 8,027,595 B2
(45) Date of Patent: Sep. 27, 2011

(54) METHOD AND APPARATUS TO STORE INFORMATION ON AMOUNT OF TONER USED, AND IMAGE FORMING DEVICE USING THE SAME

(75) Inventors: Il-su Lee, Hwaseong-si (KR); Yong-geun Kim, Suwon-si (KR); Hae-seog Jo, Yongin-si (KR); Chang-bok Lee, Hwaseong-si (KR); Young-kak Lim, Gunpo-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 457 days.

(21) Appl. No.: 11/969,408

(22) Filed: Jan. 4, 2008

(65) Prior Publication Data

US 2008/0166144 A1 Jul. 10, 2008

(30) Foreign Application Priority Data

Jan. 5, 2007 (KR) ..... 10-2007-0001713

(51) Int. Cl.
*G03G 15/08* (2006.01)
*G03G 15/00* (2006.01)

(52) U.S. Cl. ..... 399/12; 399/25

(58) Field of Classification Search ..... 399/12, 399/27, 30, 61–64, 25, 111
See application file for complete search history.

(56) References Cited

U.S. PATENT DOCUMENTS

| | | | | |
|---|---|---|---|---|
| 6,363,226 | B1 * | 3/2002 | Batori | 399/8 |
| 6,408,141 | B1 * | 6/2002 | Tahara | 399/12 |
| 6,915,094 | B2 * | 7/2005 | Tsuruya et al. | 399/227 |
| 7,043,169 | B2 * | 5/2006 | Ito et al. | 399/27 |
| 7,077,520 | B2 * | 7/2006 | Ikeda et al. | 351/178 |
| 7,221,467 | B2 * | 5/2007 | Hayashi et al. | 358/1.15 |
| 7,330,673 | B2 * | 2/2008 | Eom | 399/24 |
| 7,477,854 | B2 * | 1/2009 | Nakazawa et al. | 399/12 |

FOREIGN PATENT DOCUMENTS

| | | | |
|---|---|---|---|
| JP | 2002169427 A | * | 6/2002 |
| JP | 2002207401 A | * | 7/2002 |
| JP | 2004045861 A | * | 2/2004 |

* cited by examiner

*Primary Examiner* — Robert Beatty
(74) *Attorney, Agent, or Firm* — Stanzione & Kim, LLP

(57) ABSTRACT

A method and apparatus to store information on an amount of toner used. The method includes determining whether a customer replaceable unit monitor (CRUM) memory to store information on an amount of used toner is included in a cartridge of an image forming device; storing the information on the amount of used toner in a non-volatile memory of the image forming device when the CRUM memory is not included in the cartridge of the image forming device; and storing the information on the amount of used toner in the CRUM memory when the CRUM memory is included in the cartridge.

19 Claims, 2 Drawing Sheets

METHOD AND APPARATUS TO STORE INFORMATION ON AMOUNT OF TONER USED, AND IMAGE FORMING DEVICE USING THE SAME

CROSS-REFERENCE TO RELATED APPLICATIONS

This application claims priority under 35 U.S.C. §119(a) from Korean Patent Application No. 10-2007-0001713, filed on Jan. 5, 2007, in the Korean Intellectual Property Office, the disclosure of which is incorporated herein in its entirety by reference.

BACKGROUND OF THE INVENTION

1. Field of the Invention

The present general inventive concept relates to an image forming device, and more particularly, to a method of checking a life span of initial toner when an image forming device uses a cartridge having a customer replaceable unit monitor (CRUM) memory and a cartridge having no CRUM memory.

2. Description of the Related Art

Image forming devices, such as printers, are generally provided with consumables, such as toner cartridges, when manufactured in order to enable the use of the image forming device at an initial stage, which are unlike retail consumables that are for sale. Toner cartridges generally do not have a customer replaceable unit monitor (CRUM) memory that stores the amount of toner used in cartridges, in order to reduce manufacturing costs. Cartridges having the CRUM memory make it possible to check consumables by storing information on an amount of used toner in the CRUM, whereas cartridges having no memory storing information on an amount of remaining toner make it impossible to check the life span of toner since there is no information on an amount of used toner. Therefore, it is impossible to determine how much toner remains, so that users cannot be informed of information on the amount of remaining toner. Moreover, since users cannot be informed of how much toner remains, it is impossible to determine when to purchase a new toner cartridge. If cartridges, which were installed when image forming devices were being manufactured, have no CRUM memory, and retail cartridges have the CRUM memory, it is impossible to initialize toner and properly indicate CRUM information. Furthermore, when cartridges that are not empty are reinstalled, it is difficult to determine whether to reuse them.

SUMMARY OF THE INVENTION

The present general inventive concept provides a method and apparatus to store information on an amount of toner used in a customer replaceable unit monitor (CRUM) memory or a non-volatile memory of an image forming device according to whether the image forming device includes the CRUM memory, thereby reducing costs to manufacture a cartridge and providing a user with the information on an amount of used toner.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a method of storing information on an amount of used toner, the method including determining whether a customer replaceable unit monitor (CRUM) memory to store information on an amount of used toner is included in a cartridge of an image forming device, storing the information on the amount of used toner in a non-volatile memory of the image forming device when the CRUM memory is not included in the cartridge of the image forming device, and storing the information on the amount of used toner in the CRUM memory when the CRUM memory is included in the cartridge.

The foregoing and/or other aspects and utilities of the present general inventive concept are also achieved by providing an apparatus to store information on an amount of used toner, the apparatus including a non-volatile memory to store the information on the amount of used toner, a CRUM memory determination unit to determine whether a CRUM memory is included in a cartridge included in an image forming device, and a memory controller to control the non-volatile memory to store the information on the amount of used toner when the CRUM memory determination unit determines that the CRUM memory is not included in the cartridge, and to control the CRUM memory to store the information on the amount of used toner when the CRUM memory determination unit determines that the CRUM memory is included in the cartridge.

The foregoing and/or other aspects and utilities of the present general inventive concept are also achieved by providing an image forming device including a non-volatile memory to store information on an amount of used toner, a CRUM memory determination unit to determine whether a CRUM memory is included in a cartridge included in the image forming device, and a memory controller to control the non-volatile memory or the CRUM memory to store the information on the amount of used toner according to a determination of whether the CRUM memory is included in a cartridge, wherein a cartridge having the CRUM memory and a cartridge having no CRUM memory are installed in the image forming device.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
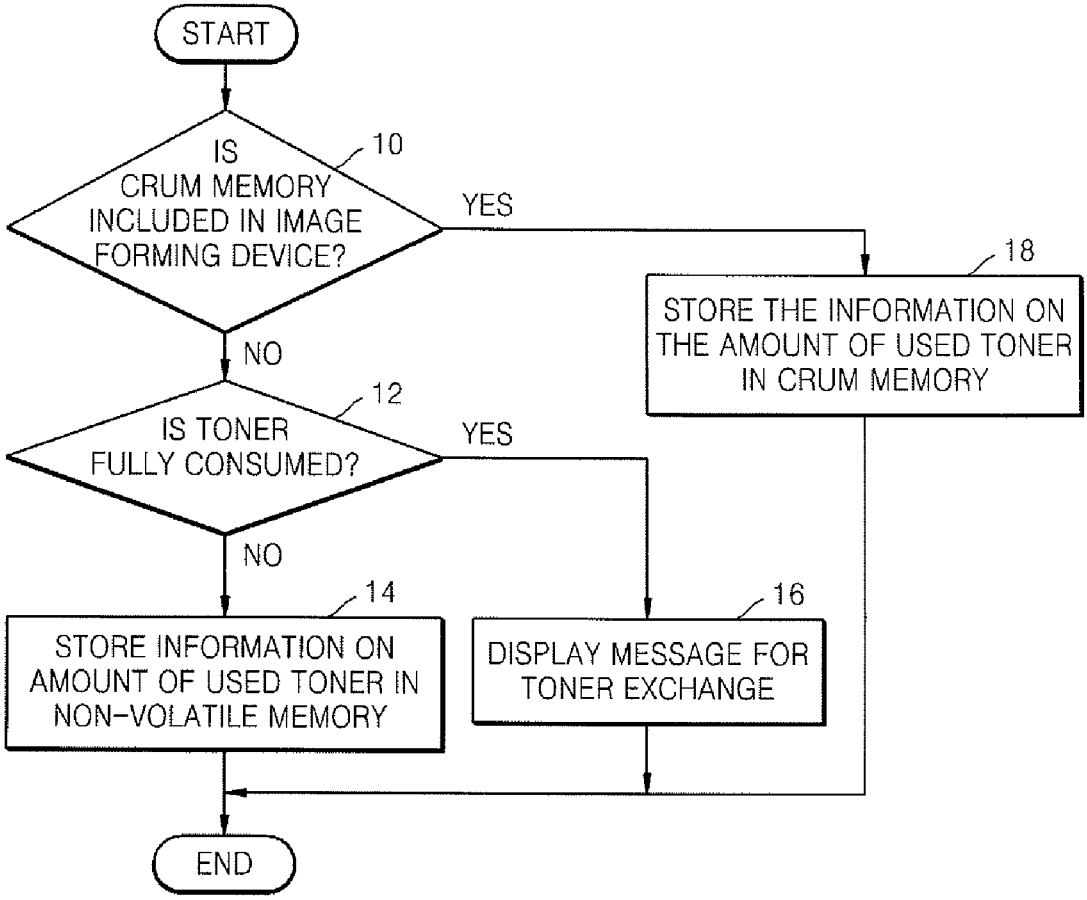
FIG. 1 is a flowchart illustrating a method of storing information on an amount of used toner according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a flowchart illustrating a method of storing information on an amount of used toner according to an embodiment of the present general inventive concept. Referring to FIG. 1, it is determined whether a cartridge included in an image forming device includes a customer replaceable unit monitor (CRUM) memory to store information on an amount of used toner in operation 10.

If the CRUM memory is not included in the cartridge, it is determined whether the toner of the cartridge is below the threshold amount in operation 12. No inclusion of the CRUM memory in the cartridge can indicate that the cartridge was installed in the image forming device when the image forming device was manufactured and that the cartridge does not include the CRUM memory. The threshold amount is a reference amount indicating that toner remaining in the cartridge is low or that toner does not remain therein. It can be determined whether the toner of the cartridge is below the threshold amount by using information on a number of dots used to print or by detecting a signal to indicate that the initial toner cartridge is empty.

If the toner of the cartridge is not below the threshold amount, information on the amount of used toner is stored in a non-volatile memory of the image forming device in operation 14. It can be determined whether the toner of the cartridge is not below the threshold amount according to results showing that the number of dots used to print does not exceed a threshold value or that the signal to indicate that the initial toner cartridge is empty is not detected. As described above, the information on the amount of used toner can be information on the number of dots used to print. The non-volatile memory is a storage medium, such as a read only memory (ROM), a programmable read only memory (PROM), an erasable and programmable read only memory (EPROM), a one time programmable read only memory (OTP), an electrically erasable programmable read-only memory (EEPROM), a flash memory, and the like, included in the image forming device, unlike a CRUM memory included in a retail toner cartridge that is for sale. The non-volatile memory is used as a space to store the information on the amount of used toner according to the present general inventive concept while also storing several programs and data used to operate the image forming device. To this end, address information on the space to store the information on the amount of used toner is preallocated.

If it is determined that the toner of the cartridge is below the threshold amount in operation 12, a message is displayed for toner exchange in operation 16. The toner below the threshold amount indicates that little or no initial toner remains. Therefore, the message for toner exchange is displayed on a screen in order to exchange the initial toner cartridge with the retail toner cartridge. The user can determine that the life span of the initial toner cartridge is over by checking the message for the toner exchange and exchange the initial toner cartridge with the retail toner cartridge. The message is displayed on the image forming device or a host connected to the image forming device.

If it is determined that the CRUM memory is included in the cartridge in operation 10, the information on an amount of used toner is stored in the CRUM memory in operation 18. Inclusion of the CRUM memory in the cartridge indicates that the cartridge included in the image forming device is the retail cartridge including the CRUM memory. If the retail cartridge is determined to be included in the image forming device, the information on the amount of used toner is stored in the CRUM memory included in the retail cartridge. Information on the number of dots can be stored as the information on the amount of used toner.

The present method general inventive concept can also be embodied as computer readable code on a computer readable recording medium. In more detail, a computer readable recording medium storing a program to execute a method of determining if the CRUM memory storing the information on the amount of used toner is included in the cartridge included in image forming device; if the CRUM memory is not included in the cartridge, storing the information on the amount of used toner in a non-volatile memory of the image forming device; and if the CRUM memory is included in the cartridge, storing the information on the amount of used toner in the CRUM memory.

For example, the computer readable recording medium can be any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves. The computer readable recording medium can also be distributed network coupled computer systems so that the computer readable code is stored and executed in a distributed fashion. Also, functional programs, code and code segments to accomplish the present general inventive concept can be easily construed by programmer skilled in the art to which the present general inventive concept pertains.

Hereinafter, an apparatus to store information on the amount of used toner according to the present general inventive concept will now be described with reference to FIG. 2.

Figure 2:
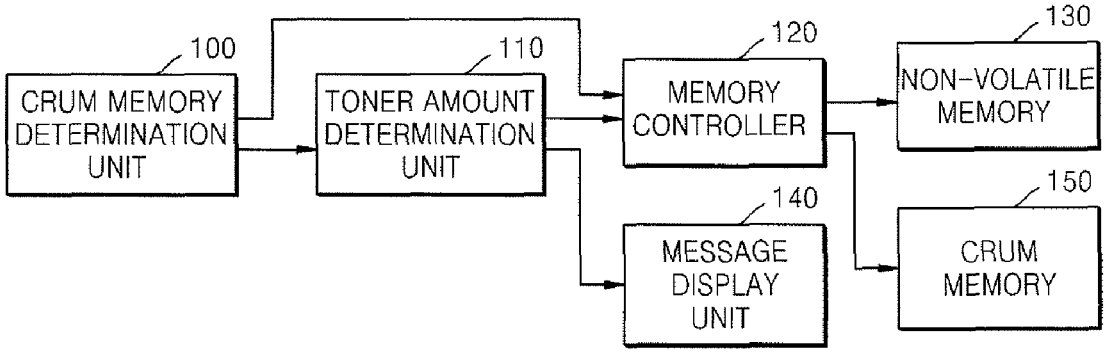
FIG. 2 is a block diagram of an apparatus to store information on an amount of used toner according to an embodiment of the present general inventive concept.

FIG. 2 is a block diagram of the apparatus to store information on the amount of used toner according to an embodiment of the present general inventive concept. The apparatus to store information on the amount of used toner may include a CRUM memory determination unit 100, a toner amount determination unit 110, a memory controller 120, a non-volatile memory 130, a message display unit 140, and a CRUM memory 150.

The CRUM memory determination unit 100 determines if the CRUM memory 150 storing the information on the amount of used toner is included in a cartridge included in an image forming device, and outputs a determination result to the toner amount determination unit 110 or the memory controller 120.

No inclusion of the CRUM memory 150 in the cartridge of the image forming device can indicate that the cartridge was installed in the image forming device when the image forming device was manufactured and that the cartridge does not include the CRUM memory 150. The CRUM memory determination unit 100 outputs the determination result that the CRUM memory 150 is not included in the cartridge of the image forming device to the toner amount determination unit 110. The CRUM memory determination unit 100 outputs the determination result that the CRUM memory 150 is included in the cartridge of the image forming device to the memory controller 120.

If the toner amount determination unit 110 receives the determination result that the CRUM memory 150 is not included in the cartridge of the image forming device from the CRUM memory determination unit 100, the toner amount determination unit 110 determines whether the toner of the cartridge included in the image forming device is below the threshold amount, and outputs a determination result to the memory controller 120 or the message display unit 140. The toner amount determination unit 110 can determine whether the toner of the cartridge included in the image forming device is below the threshold amount by using information on the number of dots used to print or by detecting a signal to indicate that the initial toner cartridge is empty. The toner amount determination unit 110 outputs the determination result of that the toner of the cartridge included in the image forming device is not below the threshold amount to the memory controller 120. The toner amount determination unit 110 can determine whether the toner of the cartridge included in the image forming device is not below the threshold amount according to results showing that the number of dots used to print does not exceed a threshold value or that the signal to indicate that the initial toner cartridge is empty is not detected. The toner amount determination unit 110 outputs the determination result that the toner of the cartridge included in the image forming device is below the threshold amount to the message display unit 140.

If the memory controller 120 receives the determination results that the CRUM memory 150 is not included in the cartridge of the image forming device and the toner of the cartridge included in the image forming device is below the threshold amount from the toner amount determination unit 110, the memory controller 120 controls the non-volatile memory 130 to store the information on the amount of used toner. If the memory controller 120 receives the determination result that the CRUM memory 150 is included in the cartridge of the image forming device from the toner amount determination unit 110, the memory controller 120 controls the CRUM memory 150 to store the information on the amount of used toner. Inclusion of the CRUM memory 150 in the cartridge of the image forming device indicates that the cartridge included in the image forming device is a retail cartridge that is for sale including the CRUM memory 150. If the retail cartridge is determined to be included in the cartridge of the image forming device, the memory controller 120 stores the information on the amount of used toner in the CRUM memory 150 included in the retail cartridge. The information on the amount of used toner can be determined according to information on a number of dots used to print or by detecting a signal to indicate that the retail cartridge is empty.

The non-volatile memory 130 is a storage medium, such as ROM, a PROM, an EPROM, an OTP, an EEPROM, a flash memory, and the like, included in the image forming device, unlike the CRUM memory 150 included in the retail cartridge. The non-volatile memory 130 is used as a space to store the information on the amount of used toner according to the present general inventive concept while also storing several programs and data used to operate the image forming device. To this end, address information on the space to store the information on the amount of used toner is pre-allocated. The non-volatile memory 130 may differentiate a storage space in order to divide and store the information on the amount of used toner according to the determination result of the CRUM memory determination unit 100. For example, the information on the amount of used toner is stored in a predetermined area of the non-volatile memory 130 in response to the determination result of the CRUM memory determination unit 100 that the CRUM memory 150 is not included in the cartridge, and the information on the amount of used toner is stored in another area of the non-volatile memory 130 in response to the determination result of the CRUM memory determination unit 100 that the CRUM memory 150 is included in the cartridge.

If the message display unit 140 receives the determination result that the toner of the cartridge is below the threshold amount from the toner amount determination unit 110, the message display unit 140 displays a message for toner exchange. Full consumption of the toner indicates that a life span of the cartridge is over. Therefore, the message display unit 140 displays the message for cartridge exchange on a screen in order to exchange cartridges.

The CRUM memory 150 is installed in the cartridge and can store the information on the amount of used toner of the retail cartridge according to the control of the memory controller 120. The CRUM memory 150 can store information on the number of dots as the information on the amount of used toner.

A device to store information on an amount of used toner may be included in an image forming device including a printer, a multifunctional, a copier, and the like. The CRUM memory determination unit 100, the toner amount determination unit 110, the memory controller 120, the non-volatile memory 130, the message display unit 140, and the CRUM memory 150 can be included in the image forming device.

The description of each element is the same as stated above. However, the memory controller 120 may control the CRUM memory 150 and the non-volatile memory 130 to store the information on the amount of used toner in response to the determination result of the CRUM memory determination unit 100 that the CRUM memory 150 is included in the cartridge.

According to the present general inventive concept, the method and apparatus to store the information on an amount of used toner in a CRUM memory or a non-volatile memory of an image forming device according to whether the CRUM memory is included in a cartridge of the image forming device, providing a user with the information on the amount of used toner although a cartridge having no CRUM memory is installed in the image forming device, reducing costs to manufacture the initial toner cartridge, thereby increasing efficiency in checking consumables of the image forming device.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of storing information on an amount of used toner, the method comprising:

determining whether a customer replaceable unit monitor (CRUM) memory to store information on an amount of used toner is included in a cartridge of an image forming device each time a cartridge is installed in the image forming apparatus;

storing the information on the amount of used toner in a non-volatile memory of the image forming device each time the CRUM memory is not included in the installed cartridge of the image forming device; and storing the information on the amount of used toner in the CRUM memory each time the CRUM memory is included in the installed cartridge, wherein the cartridge having no CRUM memory is installed in the image forming apparatus when the image forming apparatus was manufactured, and wherein the cartridge having no CRUM memory is able to be installed back in the image forming apparatus when the toner remaining in the cartridge is not below a threshold amount.

2. The method of claim 1, further comprising:

determining whether the toner remaining in the cartridge is below the threshold amount when it is determined that the CRUM memory is not included in the cartridge.

3. The method of claim 2, wherein the threshold amount is a reference amount indicating that toner remaining in the cartridge is low or that toner does not remain therein.

4. The method of claim 2, further comprising:

displaying a message for toner exchange when it is determined that the toner remaining in the cartridge is below the threshold amount.

5. The method of claim 4, wherein the message is displayed on the image forming device or a host connected to the image forming device.

6. A computer readable recording medium storing a program to execute a method of storing information on an amount of used toner, the method comprising:

determining whether a CRUM memory storing the information on the amount of used toner is included in a cartridge of an image forming device each time a cartridge is installed in the image forming device;

storing the information on the amount of used toner in a non-volatile memory of the image forming device when the CRUM memory is not included in the installed cartridge of the image forming device; and storing the information on the amount of used toner in the CRUM memory each time the CRUM memory is included in the installed cartridge, wherein the cartridge having no CRUM memory is installed in the image forming apparatus when the image forming apparatus was manufactured, and wherein the cartridge having no CRUM memory is able to be installed back in the image forming apparatus when the toner remaining in the cartridge is not below a threshold amount.

7. An apparatus to store information on an amount of used toner, the apparatus comprising:

a non-volatile memory to store the information on the amount of used toner;

a CRUM memory determination unit to determine whether a CRUM memory is included in a cartridge included in an image forming device each time the cartridge is installed in the image forming apparatus; and a memory controller to control the non-volatile memory to store the information on the amount of used toner each time the CRUM memory determination unit determines that the CRUM memory is not included in the cartridge, and to control the CRUM memory to store the information on the amount of used toner each time the CRUM memory determination unit determines that the CRUM memory is included in the cartridge, wherein the cartridge having no CRUM memory is installed in the image forming apparatus when the image forming apparatus was manufactured, and wherein the cartridge having no CRUM memory is able to be installed back in the image forming apparatus when the toner remaining in the cartridge is not below a threshold amount.

8. The apparatus of claim 7, further comprising:

a toner amount determination unit to determine whether the toner of the cartridge is below a threshold amount when the CRUM memory determination unit determines that the CRUM memory is not included in the cartridge.

9. The apparatus of claim 8, wherein the threshold amount is a reference amount indicating that toner remaining in the cartridge is low or that toner does not remain therein.

10. The apparatus of claim 8, further comprising:

a message display unit to display a message for toner exchange when the toner amount determination unit determines that the toner of the cartridge is below the threshold amount.

11. The apparatus of claim 10, wherein the message display unit displays the message on the image forming device or a host connected to the image forming device.

12. An image forming device comprising:

a non-volatile memory to store information on an amount of toner used;

a CRUM memory determination unit to determine whether a CRUM memory is included in a cartridge included in the image forming device each time the cartridge is installed in the image forming apparatus; and a memory controller selectively operable between a first mode to control the non-volatile memory to store the information on the amount used toner and a second mode to control the CRUM memory to store the information on the amount of used toner, according to a determination of whether the CRUM memory is included in a cartridge, wherein a cartridge having the CRUM memory and a cartridge having no CRUM memory are installed in the image forming device, wherein the cartridge having no CRUM memory is installed in the image forming apparatus when the image forming apparatus was manufactured, and wherein the cartridge having no CRUM memory is able to be installed back in the image forming apparatus when the toner remaining in the cartridge is not below a threshold amount.

13. The image forming device of claim 12, wherein the memory controller controls the non-volatile memory to store the information on the amount of used toner when the CRUM memory determination unit determines that the CRUM memory is not included in the cartridge.

14. The image forming device of claim 12, wherein the memory controller controls the CRUM memory to store the information on the amount of used toner when the CRUM memory determination unit determines that the CRUM memory is included in the cartridge.

15. The image forming device of claim 12, wherein the memory controller controls the non-volatile memory and the CRUM memory to store the information on the amount of used toner according to the determination result of the CRUM memory determination unit that the CRUM memory is included in the cartridge.

16. The image forming device of claim 12, wherein a storage space of the non-volatile memory is divided according to the determination result of the CRUM memory determination unit to store the information on the amount of used toner.

17. An image forming device including a memory, comprising:

a CRUM memory determination unit to determine whether a CRUM memory is included in a cartridge installed in the image forming apparatus; and a control module in communication with the CRUM memory determination unit to determine that the installed cartridge is a retail cartridge each time the installed cartridge includes a CRUM memory and to determine that the installed cartridge is a manufactured cartridge each time the installed cartridge does not include a CRUM memory, wherein the control module stores the information on the amount of used toner in a non-volatile memory of the image forming device each time the CRUM memory is not included in the installed cartridge of the image forming device, wherein the cartridge having no CRUM memory is installed in the image forming apparatus when the image forming apparatus was manufactured, and wherein the cartridge having no CRUM memory is able to be installed back in the image forming apparatus when the toner remaining in the cartridge is not below a threshold amount.

18. The image forming apparatus of claim 17, wherein the controller stores information about the manufactured cartridge in the memory of the image forming apparatus in response to determining that the CRUM memory is not included in the installed cartridge.

19. The image forming apparatus of claim 18, wherein the information stored in the memory of the image forming apparatus includes information indicating that the cartridge was installed in the image forming apparatus when the image forming apparatus was manufactured.

* * * * *